United States Patent [19]

Abreo, Jr.

[11] Patent Number: 4,872,708

[45] Date of Patent: Oct. 10, 1989

[54] PRODUCTION TIEBACK CONNECTOR

[75] Inventor: William A. Abreo, Jr., Houston, Tex.

[73] Assignee: Cameron Iron Works USA, Inc., Houston, Tex.

[21] Appl. No.: 51,842

[22] Filed: May 18, 1987

[51] Int. Cl.[4] ..... F16L 37/08

[52] U.S. Cl. ..... 285/39; 285/308; 285/920; 166/340; 166/345

[58] Field of Search ..... 285/18, 39, 138, 140, 285/142, 307, 308, 313, 321, 920; 166/338, 339, 340, 381, 345

[56] References Cited

U.S. PATENT DOCUMENTS

| | | | |
|---|---|---|---|
| Re. 20,529 | 10/1937 | Penick et al. | 285/142 |
| 3,497,243 | 2/1970 | Gruller et al. . | |
| 3,521,909 | 7/1970 | Brown | 166/340 X |
| 3,897,823 | 8/1975 | Ahlstone | 285/18 X |
| 3,924,679 | 12/1975 | Jansen, Jr. | 285/18 X |
| 4,019,579 | 4/1977 | Thuse | 285/18 X |
| 4,046,405 | 9/1977 | Bonds . | |
| 4,343,495 | 8/1982 | Nobileau et al. . | |
| 4,465,134 | 8/1984 | Watkins | 285/39 X |
| 4,519,633 | 5/1985 | Nichols | 285/18 X |
| 4,603,886 | 8/1986 | Pallini, Jr. et al. | 285/18 X |
| 4,615,544 | 10/1986 | Baugh | 285/18 |
| 4,651,830 | 3/1987 | Crotwell | 285/141 X |
| 4,681,166 | 7/1987 | Cuiper | 285/18 X |
| 4,696,493 | 9/1987 | Brammer | 285/3 |

*Primary Examiner*—Randolph A. Reese
*Assistant Examiner*—Anthony Knight

[57] ABSTRACT

A subsea tieback connector including an annular body having an external downwardly facing shoulder with high pressure gasket type sealing means therein, a sleeve positioned within said annular body and having means preventing relative rotation between the sleeve and the body, a lock ring, an actuator ring threaded into said sleeve and having its lower end in engagement with an internal upwardly facing shoulder on said annular body whereby rotation of said actuating ring causes said lock ring to be set and then tensions said sleeve to load the connection.

6 Claims, 2 Drawing Sheets

PRODUCTION TIEBACK CONNECTOR

BACKGROUND

It is common practice in offshore oil and gas production to have the wellhead and related casing hangers mounted at the ocean floor with the xmas tree and other production equipment mounted above the water level on a production platform. In such situations tieback conductors are used to connect the subsea wellhead equipment to the platform mounted production equipment. In a typical application the high pressure 18¾ inch casing head housing must be tied back to the production platform.

One example of a production tieback is shown in U.S. Pat. No. 4,343,495 wherein item 10 is a casing head housing which is tied back to a production platform by connector 14 and conductor 12. Connector 14 is joined to housing 10 by threaded engagement.

Another example of a tieback is disclosed in U.S. Pat. No. 3,497,243 wherein the conductor pipe 12 is threaded into wellhead housing 11.

Another tieback system is shown in U.S. Pat. No. 4,046,405 wherein the connections include threads, latching mechanisms and an axially threaded nut.

SUMMARY

The present invention is an improved marine wellhead tieback connector which has a lock ring for engagement with a running tool receiving groove of a subsea wellhead housing, a seal for sealing against the high pressure gasket sealing surface preparation at the top of the wellhead housing and means for preloading the connector to minimize cyclic deflection due to variations in loading which would cause relative movement between the seal and the housing seal area.

An object of the present invention is to provide an improved tieback connector which is not threadedly attached to the wellhead housing to which it is engaged.

Another object is to provide an improved tieback connector which is pre-loaded when attached to the wellhead housing.

A further object is to provide an improved tieback connector which readily accepts subsequent conductors therein which are to be tied back.

BRIEF DESCRIPTION OF THE DRAWINGS

These and other objects and advantages are hereinafter set forth and explained with reference to the drawings wherein.

DESCRIPTION OF THE PREFERRED EMBODIMENT

The normal subsea wellhead is positioned on the ocean floor and a platform has its support structure mounted on ocean floor around the subsea wellhead and production equipment is positioned above water level on platform. A tieback conductor or casing 10 extends from tieback connector 12 to production equipment on the platform.

Figure 1:
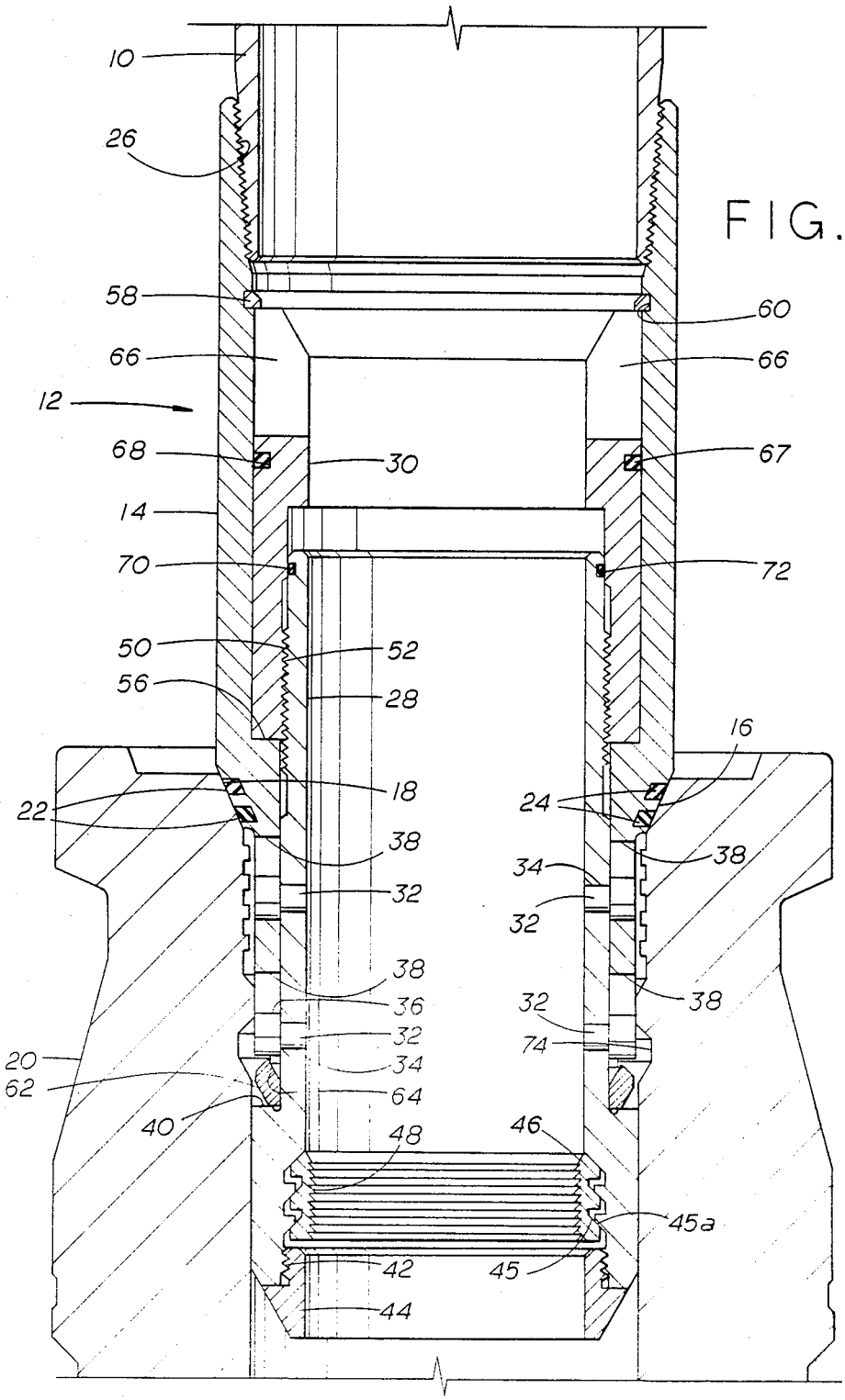
FIG. 1 is a sectional view of the improved tieback connector of the present invention in its unset position within the wellhead housing to which it is to be attached.

Tieback connector 12 includes body 14 which is generally tubular in shape and has outer downwardly facing shoulder 16 which is adapted to engage upwardly facing seat 18 on wellhead housing 20. Grooves 22 in shoulder 16 are filled with high pressure gasket type seal rings 24 for sealing against seat 18. The upper interior includes threads 26 into which tieback conductor 10 is engaged. Tieback connector 12 also includes sleeve 28 which is positioned within body 14 and actuator ring 30 which is positioned between the upper exterior portion of sleeve 28 and the interior of body 14. Pins 32 having their shanks 34 positioned within openings in sleeve 28 and their heads 36 positioned within vertical slots 38 within body 14 at a position below shoulder 16 as shown in FIG. 1. The lower exterior of sleeve 28 includes upwardly facing shoulder 40 and the lower interior of sleeve 28 includes threads 42 into which ring 44 is threaded and buttress threads 45 thereabove with the buttress threads 45a on the exterior of split latching ring 46 engaging the threads 45. Split latching ring 46 includes internal threads 48 which have their lower surfaces tapering upwardly and outwardly and their upper surfaces being substantially normal to the axis of sleeve 28. Threads 48 are relatively fine with respect to threads 45 so that there is limited relative rotation between split latching ring 46 and sleeve 28. This structure provides the support for subsequent conductor strings (not shown) to be run and to be latched in place by ring 46 since less than a full turn of the string is required to complete the setting of split latching ring 46. The upper exterior of sleeve 28 includes threads 50 into which threads 52 on the interior of actuator ring 30 engage. Actuator ring 30 includes upper slots 66 which are engaged by a suitable tool (not shown) for setting of the assembly as hereinafter described. Actuator ring 30 is retained within body 14 between internal upwardly facing shoulder 56 and snap ring 58 which is positioned within groove 60 around the upper interior of body 14 immediately below threads 16.

Split lock ring 62 is positioned on external shoulder 40 of sleeve 28 and below the lower end of body 14 which is provided with external cam surface 64 which is tapered downwardly and inwardly to coact with split lock ring 62 during setting. Seal ring 67 is positioned in groove 68 in the exterior of actuator ring 30 to seal between the exterior of actuator ring 30 and the interior of body 14. Seal ring 70 is positioned in groove 72 in the upper exterior of sleeve 28 to seal between the exterior of sleeve 28 and the interior of actuator ring 30.

Figure 2:
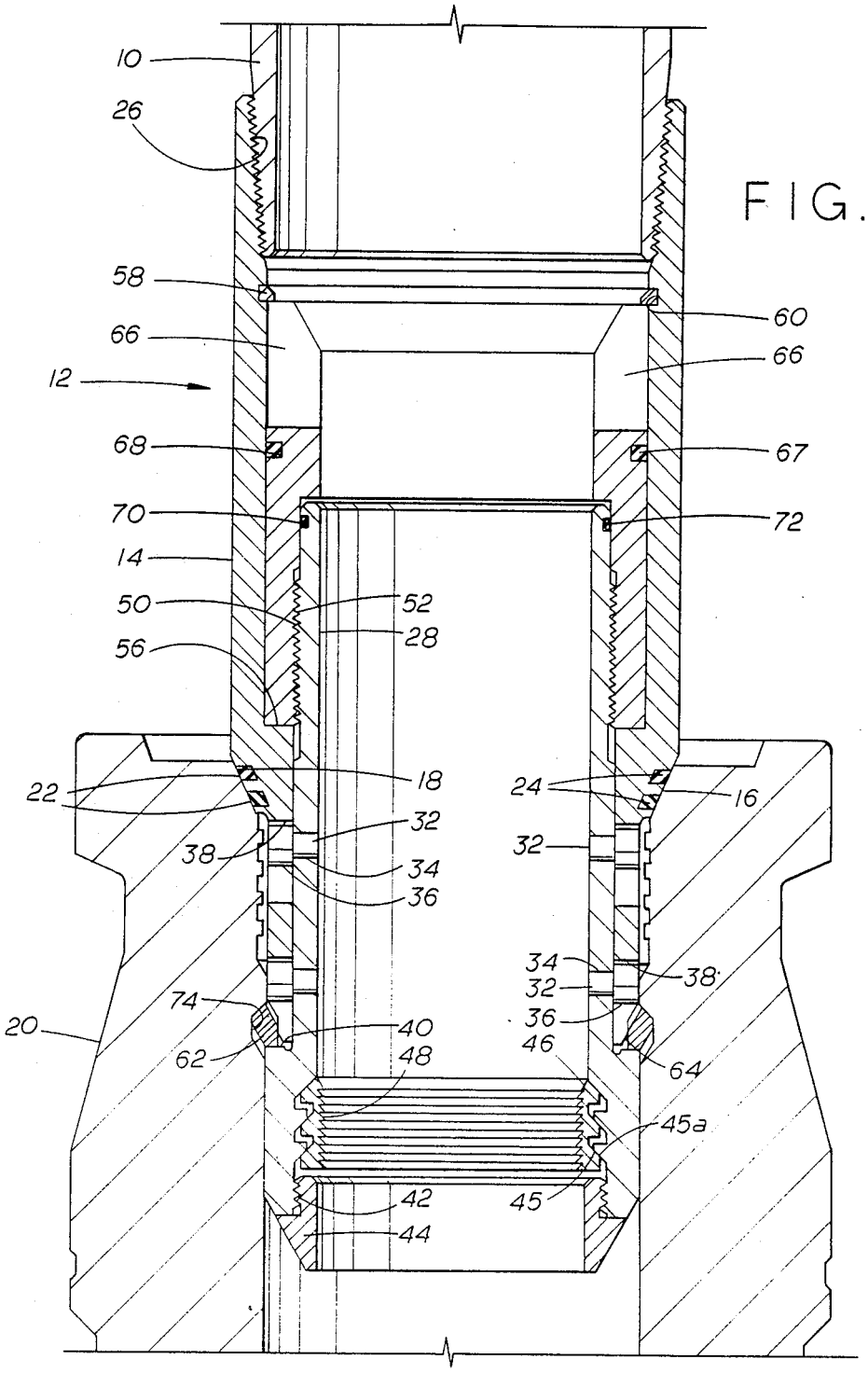
FIG. 2 is another sectional view of the improved tieback connector of the present invention after it has been attached to the wellhead housing and the connector has been pre-loaded.

As shown in FIG. 2, setting of tieback connector 12 is achieved by rotation of actuator ring 30. The threads 50 and 52 between sleeve 28 and actuator ring 30 causes sleeve 28 to move upwardly with respect to body 14. This upward movement causes split lock ring 62 to be moved upwardly by its engagement with shoulder 40 and such movement causes it to be cammed outwardly by surface 64 on the lower end of body 14 into tight engagement within running groove 74 on the interior of wellhead housing 20. Once lock ring 62 is set, further rotation creates a tension in sleeve 28 which preloads the joint to ensure tight engagement of shoulder 16 and seal rings 24 with seat 18 on the interior upper end of wellhead housing 20.

What is claimed is:

1. A subsea wellhead comprising a wellhead housing having an upper tapered seat and internal groove below such seat, a tie back connector having an annular body with an external downwardly facing shoulder sized to be landed on said housing seat and an internal upwardly facing shoulder, a sleeve positioned within said annular body and having an external upwardly facing shoulder, upper external threads and means preventing rotation of said sleeve within said annular body, a locking ring carried by said external sleeve shoulder, said annular body having a lower end with a lower outer tapered surface which tapers upwardly and outwardly, an actuator ring threaded onto said sleeve external threads and engaging said annular body internal shoulder whereby rotation of said actuator ring raises said sleeve to raise said locking ring into surrounding relationship to said lower annular body end and thus wedge said locking ring outward to set said locking ring into said housing internal groove and continued rotation of said actuator ring tensions said sleeve to preload the engagement between said wellhead housing seat and said body shoulder.

2. A tieback connector according to claim 1 including sealing means carried by said body for providing a high pressure gasket seal against a sealing surface of the wellhead housing when said connector is secured.

3. A tieback connector according to claim 1 wherein said sealing means includes at least one groove in said exterior shoulder of said body, and a high pressure sealing gasket positioned within said groove.

4. A subsea wellhead according to claim 1 wherein said rotation preventing means includes at least one pin mounted in a slot within said annular body which extends axially therein and having its other end secured within said sleeve.

5. A subsea wellhead according to claim 1 including means securing said actuating ring within said annular body and against said internal body shoulder.

6. A subsea wellhead according to claim 1 wherein said wellhead housing seat and said external body shoulder are tapered downwardly and inwardly, and including gasket means positioned to provide a high pressure seal between said housing seat and said body shoulder.

* * * * *